United States Patent [19]

Kelsay, III et al.

[11] Patent Number: 4,885,843

[45] Date of Patent: Dec. 12, 1989

[54] LAMINATED GUIDE BAR FOR CHAIN SAWS HAVING FOAM CORE

[75] Inventors: Royal E. Kelsay, III, Oregon City; Arvin A. Hille, Milwaukie, both of Oreg.

[73] Assignee: Blount, Inc., Portland, Oreg.

[21] Appl. No.: 169,995

[22] Filed: Mar. 18, 1988

[51] Int. Cl.[4] ..... B27B 17/02

[52] U.S. Cl. ..... 30/387; 264/46.5; 264/46.7

[58] Field of Search ..... 30/383, 387; 264/46.5, 264/46.7

[56] References Cited

U.S. PATENT DOCUMENTS 3,968,561 7/1976 Oakes et al. ..... 264/46.7

FOREIGN PATENT DOCUMENTS 1943917 3/1971 Fed. Rep. of Germany ..... 30/383

*Primary Examiner*—Douglas D. Watts

*Attorney, Agent, or Firm*—Robert L. Harrington

[57] ABSTRACT

A laminated guide bar is provided with a center or core laminate comprised of an adhesive-foam material that is configured to form the guide groove. The adhesive-foam core resists deformation, strongly adheres to the interfacing outer laminate sides, and is inert and impervious to oil. The core is formed in place between the outer laminates with a fixture surrounding the outer laminates and maintaining their spaced relationship. A cavity is provided in the fixture that conforms to the desired core configuration. The foam material has a controlled activation to allow assembly of the fixture and upon activation, produces the desired properties mentioned. It is desirable to roughen the inner sides of the outer steel laminates to assist the bonding action of the foam material.

5 Claims, 2 Drawing Sheets

LAMINATED GUIDE BAR FOR CHAIN SAWS HAVING FOAM CORE

FIELD OF INVENTION

This invention relates to the structure and method of producing laminated guide bars for chain saws, and more particularly to a structure and method that utilizes a foam-adhesive material as the inner layer for relative spacing and fastening of the outer laminates of a laminated guide bar.

BACKGROUND OF THE INVENTION

A chain saw is basically made up of three components. The power head includes a motor that drives a sprocket. A guide bar is attached to and extends outwardly from the sprocket of the power head. A cutting chain is entrained on the guide bar to be driven by the sprocket and guided by the guide bar for cutting operation.

The guide bar is typically an oval-shaped metal plate defining along its edge an oval path for the cutting chain. The plate or bar is typically about 0.150 inch thick and the path around the bar edge is characterized by a center groove of about 0.050 inch width flanked by side rails also of about 0.050 inch width. The saw chain is made up of side links and center links. Tang portions extend from the center links into the groove and ride in the groove to assure entrainment of the saw chain around the guide bar periphery.

Early versions of the guide bar were produced from a single thickness metal plate, e.g. a 0.150 inch thick plate with the center groove around the bar edge being machine cut. The metal plate material and the process of cutting the groove are high-cost items and have been the target for many years in development efforts to reduce the overall cost of a chain saw. A secondary factor, concerns the excessive weight of the chain saw, with the solid steel bar contributing substantially to that weight.

Out of these development efforts came the laminated bar. Using the above example, it will be appreciated that two 0.050 inch thick outer side laminates and a 0.050 inch center or core laminate, properly configured and assembled, will produce the oval-shaped bar with edge groove. The total materials cost is somewhat reduced but, more importantly, the expensive groove cutting operation is eliminated. However, added to the production cost is the cost of fastening the laminates together, typically accomplished by spot welding.

It has long been recognized that the center or core laminate does not require the high strength characteristics of steel. Numerous proposals have been made to replace the core with a lighter, less expensive material. Examples of such developments are described in U.S. Pat. Nos. 3,473,581 (Merz), 3,191,646 (Merz), 4,693,007 (Apfel), and 4,383,590 (Pantzar).

The problem with these prior proposals is that replacement materials somewhat reduce weight and materials cost but add new problems that have generally resulted in as high or higher total production cost. Fastening the outer laminates in the appropriate relative spacing is a major consideration. Also, not previously discussed, is the desirability of forming the grooves so that the oil for lubrication can be injected into the groove and available for the various sliding components, i.e. the saw chain's side links sliding on the bar rails and the tang of the center link sliding along the sides of the bar groove.

BRIEF DESCRIPTION OF THE INVENTION

The present invention is believed to provide a solution for the replacement of the steel core laminate in a laminated guide bar that accomplishes a substantial reduction in materials cost coupled with a substantial reduction in the cost of production, all without sacrificing performance. It furthermore reduces the weight of the bar.

The invention involves the use of a foam material that functions as a spacer and adhesive, and is sufficiently impervious to oil to accommodate conventional oil lubrication of the chain and bar. In a preferred embodiment, a sandwich is formed including the two outer laminates and an inner forming plate having a core forming cavity that functions as a spacer and foam mold. A closed cell polyurethane adhesive foam material is provided between the laminates inside the cavity of the forming plate. The sandwich of layers is clamped together to prevent separation. Activation of the foam material generates a foam inner layer or core that assumes the shape of the cavity, i.e. the desired shape of the center or core laminate. The core forming plate is then removed.

The foam material firmly bonds to the outer laminates and when cured, strongly resists both compressive and tension forces. No other fastening is necessary. The foam material is impervious to the oil lubricants. The oil can be injected into the groove and will not be absorbed by the foam material.

A further operation that is desirable is a roughening of the side plates to enhance the mechanical gripping of the foam adhesive. The invention will be more clearly understood by reference to the following detailed description and drawings wherein.

Figure 1:
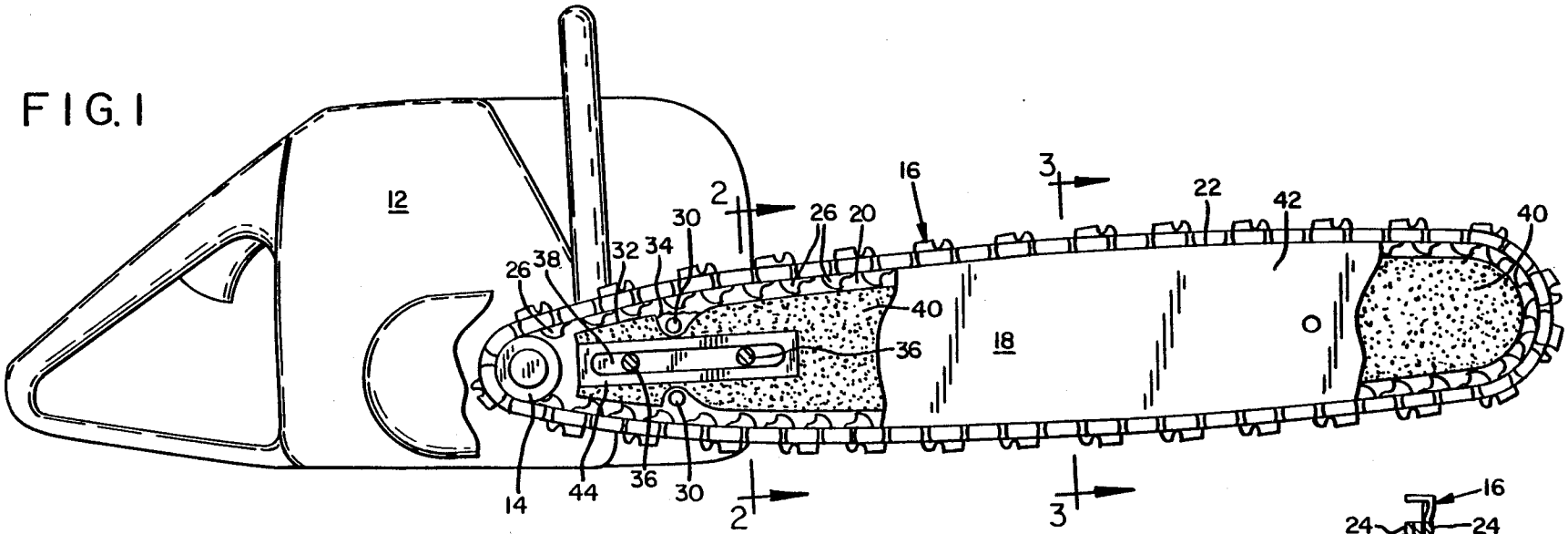
FIG. 1 illustrates a chain saw having a guide bar in accordance with the present invention.

FIG. 1 illustrates a typical chain saw but including a guide bar of the present invention. A power head 12 including the various controls, drives a drive sprocket 14. The drive sprocket 14 in turn drives a saw chain 16 which is entrained on the edge or periphery of a guide bar 18.

Figure 3:
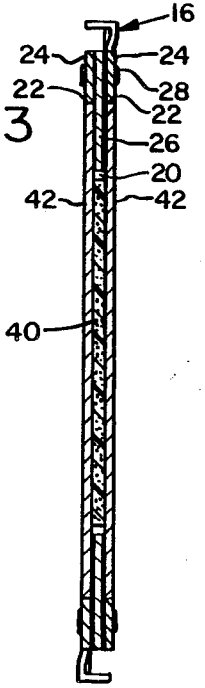
FIG. 3 is section view as taken on view lines 3—3 of FIG. 1.
Figure 2:
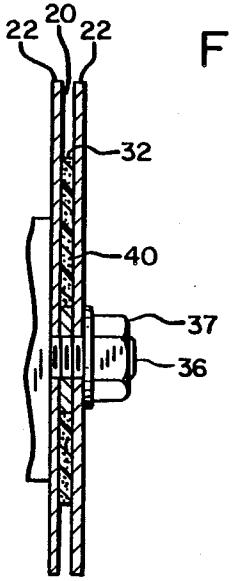
FIG. 2 is a section view as taken on view lines 2—2 of FIG. 1.

The guide bar 18 is shown in cross section in FIGS. 2 and 3. FIG. 2 shows the guide bar without the saw chain and it will be noted that the edge of the bar is provided with a groove 20 flanked by side rails 22. As noted from FIGS. 1 and 3, the saw chain 16 is made up of side links 24 that ride on the bar rails 22 and center links that have tang portions 26 that extend into the bar grooves 20. Rivets 28 pivotally attach the chain links together. Tang portions 26 provide the dual function of being engaged by the teeth of the sprocket 14 as well as riding in the bar groove 20 to prevent the saw chain from sliding off the guide bar edge.

The saw chain slides along the guide bar on the top of the bar rails and slides along the sides of the bar groove as will be apparent from FIG. 3. These surfaces are lubricted by injecting oil into holes 30. The oil forms a pool in the groove bottom 32, e.g. as indicated by reference 34. The tang portions pick up the oil and through centrifugal force spreads the oil along the groove sides and rails of the guide bar. (The lower oil hole 30 is provided because the bar is typically reversible to balance the wearing of the bar edges. Only the upper hole is used for lubrication.)

The guide bar 18 is mounted to the power head 12 by mounting bolts 36 that fit through a rear slot 38 in the guide bar. This bolt and slot arrangement enables the operator to loosen and tighten the chain, i.e. by moving the bar toward or away from the drive sprocket 14. The bar is held in place by simply clamping the bar to the power head through the tightening of nuts 37 (FIGS. 2 and 5) on the bolts 36.

The above details are all common to laminated guide bars as mounted on chain saws. Whereas they do not form a part of the invention, they do impact on certain of the features of the invention which will now be explained.

The invention concerns the provision of a light weight, inexpensive foam-adhesive core laminate 40 provided between two steel (metal) outer laminates 42. The core material has the properties of being chemically inert to gas and oil and generally impervious to the lubricating oil, i.e. to enable oil pooling in the groove as indicated by reference 34 in FIG. 1. It must be capable of conforming to the desired configuration of a core laminate while positioned between the outer steel laminates, and in so conforming, it must be capable of strongly adhering to the inside of the outer laminates. When formed or cured, it must be strongly resistant to deformation from either compression or tension forces.

The foam material which has been found to satisfy these properties is a closed cell polyurethane foam that has a controlled activation. Specifically, one foam material that has been found to work is available from Biwax Corporation of Des Plaines, Ill. It is recommended as a rigid urethane foam for potting or packaging. It is identified as Biwax 82.460-R that is activated by a resin-catalyst identified as Biwax 82.460-C. The two parts are thoroughly mixed at a ratio by weight of 54.5 parts of the resin to 45.5 parts of the catalyst. It has a pot-life, i.e. before activation, of 20 seconds at 23 degrees centigrade temperature. The recommended cure time is 10 minutes at room temperature. Upon curing, it has a density of about 5 pounds per cubic foot.

Whereas the foam core has been found to be satisfactorially rigid in general, a problem that was encountered was that of over-tightening the mounting bolts 36. With only the foam core spacing the outer steel laminates, the high compression that can be generated from clamping the bar onto the power head can cause some squeezing of the core material with the resultant closing of the groove 20 and binding of the drive tang portions therebetween. To overcome this problem, a rigid metal spacer ring 44 is positioned around the mounting slot 38, between the laminates 42 and then embedded in, or more accurately replacing, the core material immediately around slot 38.

Figure 5:
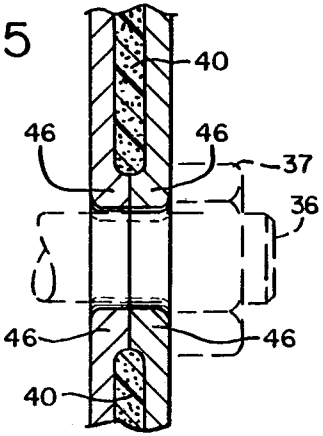
FIG. 5 is a further variation of the guide bar shown in FIG. 1.

An alternate solution to the just-described problem of closing or pinching the outer laminates in the mounting area, is illustrated in FIG. 5. Rather than providing a spacer ring 44 as a separate piece, the outer laminates can be produced in a manner whereby a metal rib 46 is formed after blanking of the slot 38. An excess of material would be provided during blanking and that material would be rolled over. Those skilled in the metal forming art will readily accomplish this rib forming operation. In the embodiment illustrated, a rib 44 is formed out of both outer laminates and abut to provide a spacer ring that functions in the same manner as spacer ring 44. A further alternative would be to form the full depth of the spacing "rib" out of one of the laminates.

Figure 4:
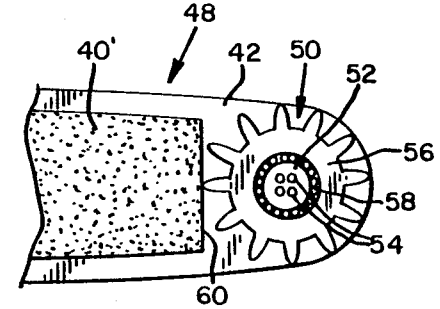
FIG. 4 is a variation of the guide bar shown in FIG. 1.

Reference is now made to FIG. 4 which illustrates the application of the invention to a sprocket nose bar. FIG. 4 shows the nose end of a bar 48 but with the near side outer laminate removed, i.e. it is a view similar to the nose portion of the bar illustrated in FIG. 1 where the near side outer laminate is broken away. Very simply, the bar is fitted with a conventional sprocket nose assembly 50 consisting of a mounting hub 52 secured between the outer laminates 42 by rivets 54. A sprocket 56 is rotatably mounted around the mounting hub 52 on roller bearings 58.

There are numerous ways to provide the sprocket nose in a sprocket nose bar and the particular structure is not pertinent. The structure of FIG. 4 is provided only to demonstrate that the core laminate 40' is simply configured as necessary to accommodate the sprocket nose structure, i.e. in the illustrated embodiment the core laminate is shortened so as to terminate at end 60 just short of the sprocket nose assembly. The manner of forming the core laminate configuration of the various bar types involves the method or process of manufacture which will now be explained.

PROCESS OF MANUFACTURE

Figure 6:
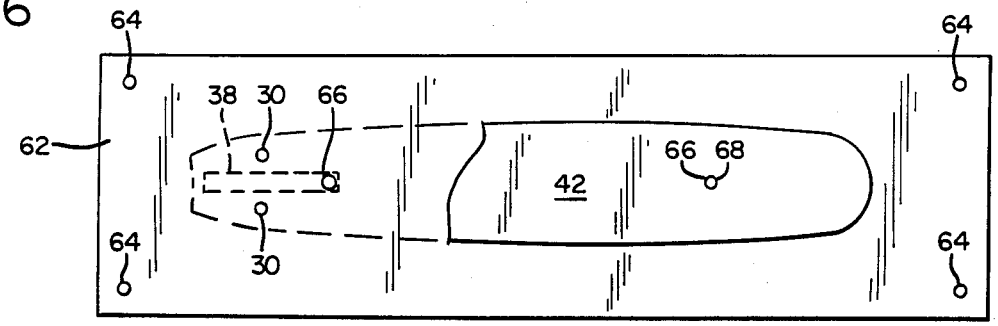
FIGS. 6 through 10 illustrate the process of producing the guide bar of FIG. 1.
Figure 10:
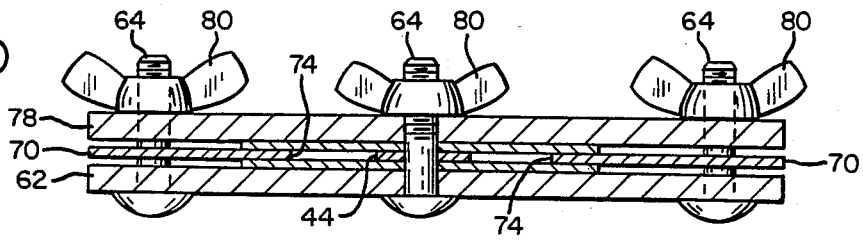

FIGS. 6 through 10 illustrate the process or method of manufacturing the guide bar with a foam core laminate of the present invention. Reference is made to FIGS. 6 and 10 (FIG. 10 being a cross section of the fully assembled bar and fixture as indicated by view lines 10—10 of FIG. 9). A fixed steel plate 62 is provided with a number of locating posts, e.g. four corner locating posts 64 for positioning the components of the fixture, as will be explained, and two center locating posts 66 for positioning the outer laminates 42 in the fixture, as will also be explained.

A first outer laminate 42 is positioned on the posts 66. A forwardly located hole 68 is provided in the laminate 42 for the specific purpose of mounting it over the forward locating post 66. The rearwardly positioned post 66 is located to project through slot 38 already provided in the laminate, i.e. for assembly onto the mounting bolts 36 of the chain saw. Holes 30 for the lubricating oil are shown in laminate 42 but are not provided with posts, although of course a variety of post arrangements will accomplish the same purpose.

Figure 7:
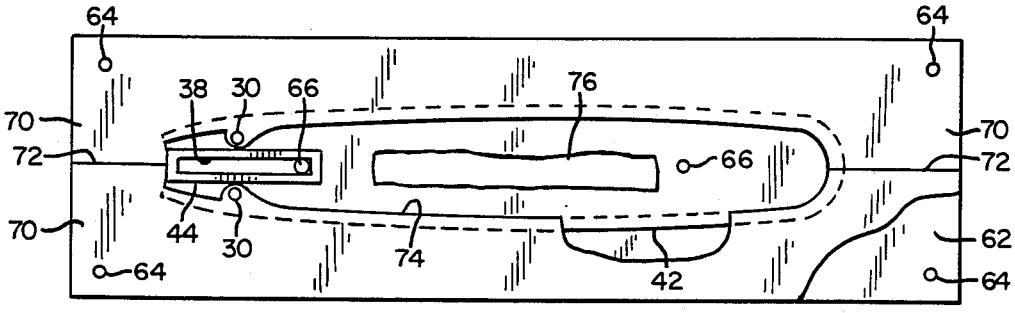
Figure 8:
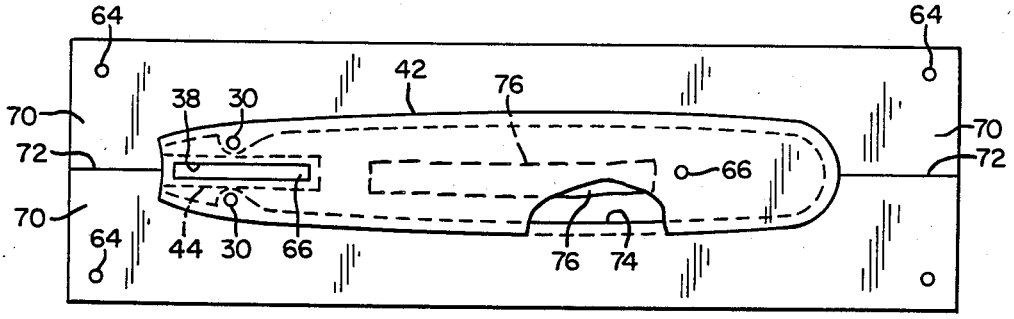
Figure 9:
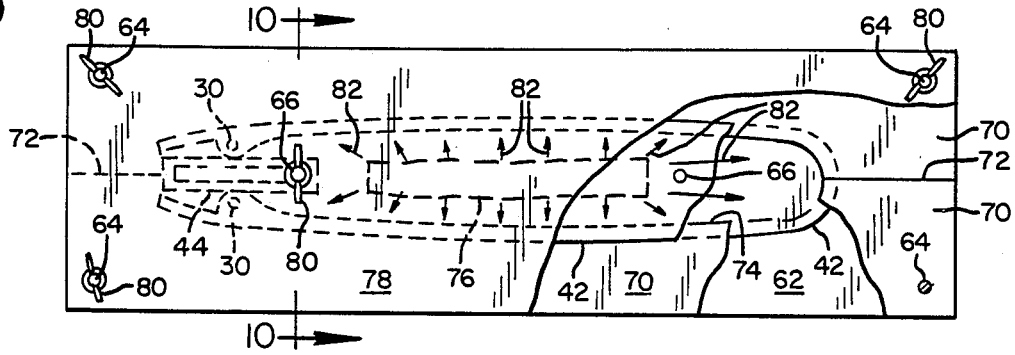

The next step is shown in FIG. 7. A core forming plate 70 is provided as two separate pieces as indicated by the break line 72. Plate sections 70 are mounted onto locating posts 64 and are mounted to cooperatively provide an inner cavity defined by inner edge 74. It will be noted that edge 74 follows a path that necks down inside of oil holes 30 in the laminate 42 to avoid having the foam fill in these holes. Obviously the hole 30 positions could be moved outwardly into the bar groove as in some existing laminated bars, or pegs or locating posts could be projected up through the holes 30.

With the forming plate 70 in place, the spacer ring 44 is placed around the slot 38 and the process is now ready for the foam material. The foam material, as explained, is a two-part urethane foam. The two parts are thoroughly mixed together and a ribbon 76 of the mixed but non-activated foam material is laid inside the cavity formed by edge 74.

The remainder of the parts are then immediately assembled. From FIG. 8, the outer laminate 42 is placed on the locating post 66 over the core forming plate 70. From FIG. 9, a second thick plate 78 is laid over the entire assembly and wing nuts 80 are screwed onto the locating posts 64 and 66 to clamp the assembly together as the ribbon 76 of foam material activates and expands into the cavity of edge 74. This expansion is indicated by arrows 82 in FIG. 9.

The fixture and guide bar components are left assembled for the desired period of time, e.g. 10 minutes, to allow expansion and curing of the foam material. During that time, the foam material fills the entire void defined by edge 74 and when cured is substantially rigid. The fixture is then disassembled by removing plates 78 and 62 which are simply lifted away from the bar after removing nuts 80 and withdrawing posts 64 and 66. The forming plate 70 can then be pulled away from the sides of the foam core (out of the now formed groove 20) and the bar is completed.

As mentioned in the introductory portion, a preparatory process step that was found beneficial was the roughening of the inside of the laminate plate 42. Whereas the foam-adhesive material 40 produces a substantial chemical bonding action for adhering to the steel surfaces, roughening the surface to permit mechanical gripping of the foam material to the surface has been found to significantly enhance the overall bond strength of the foam material. A number of processes for roughening a steel surface are available. In the example referred to and explained, the plates were roughened by sand blasting. This created a pitting of the surface which is believed to add the desired mechanical gripping.

Others familiar with the art will conceive of numerous variations to those features herein described as the preferred embodiment. The invention is not limited to those features but is encompassed by the definitions as set forth in the claims appended hereto.

We claim:

1. A guide bar for a chain saw comprising; two outer rigid metal laminates spaced apart in a fixed relationship to define a guide groove along the peripheral edge of the bar, said laminates fixed together in spaced relationship by a foam-adhesive core laminate, said core laminate being a foam activating material that is activated within a confined and determined space defined in part by the outer laminates and molded thereby into a substantially non-deformable pre-determined configuration that adheres through said activation to the outer laminates.

2. A guide bar as defined in claim 1 including a rigid spacer between the metal laminates to enhance the non-deformability of the core laminate.

3. A guide bar as defined in claim 2 wherein the bar is provided at one end with a mounting slot, the rigid spacer provided between the outer laminates surrounding said mounting slot to prevent compression of the foam core by the clamping action of mounting the bar to a chain saw.

4. A guide bar as defined in claim 3 wherein the rigid spacer is provided by a metal rib formed out of at least one of the metal laminates.

5. A guide bar as defined in claim 1 wherein the three laminates are substantially equal in width, the side laminate edges providing support rails for side links of a saw chain that is substantially the same width as the center link guide groove.

* * * * *